United States Patent [19]

Eigenmann

[11] 4,376,007

[45] Mar. 8, 1983

[54] MACHINE FOR PREPARING ROAD SURFACES AND FORMING TRAFFIC REGULATING LINES THEREON

[76] Inventor: Ludwig Eigenmann, Vacallo, Canton Ticino, Switzerland

[21] Appl. No.: 249,341

[22] Filed: Mar. 31, 1981

Related U.S. Application Data

[63] Continuation of Ser. No. 868,343, Jan. 10, 1978, abandoned.

[30] Foreign Application Priority Data

Jan. 12, 1977 [IT] Italy ..... 19211 A/77

[51] Int. Cl.[3] ..... E01C 23/14

[52] U.S. Cl. ..... 156/497; 156/64; 156/71; 156/82; 156/273.3; 156/320; 156/322; 156/379; 156/499; 156/523; 156/577; 404/12; 404/72; 404/73; 404/93; 404/94; 404/95

[58] Field of Search ..... 40/612; 180/1 AP; 156/71, 82, 64, 272, 320, 497, 499, 523, 526, 574, 577, 379, 378, 273.3, 322; 404/12, 14, 72, 73, 93, 94, 95

[56] References Cited

U.S. PATENT DOCUMENTS

| | | | |
|---|---|---|---|
| 2,875,675 | 3/1959 | Searight | 404/94 |
| 3,007,838 | 11/1961 | Eigenmann | 156/526 |
| 3,011,412 | 12/1961 | Harrington et al. | 404/12 |
| 4,102,718 | 7/1978 | Eigenmann | 156/71 |

*Primary Examiner*—Edward C. Kimlin
*Assistant Examiner*—Robert A. Dawson
*Attorney, Agent, or Firm*—Michael J. Striker

[57] ABSTRACT

A method for forming a traffic regulating line or like sign on a roadway pavement even if the surface pavement is very wet and generally during very unfavorable weather, the method comprising maintaining the surface area on which the sign is to be formed and the means for forming it into a confined environment sheltered from the weather, and includes the sequential steps of washing said area, drying it and locally heating the pavement up to a temperature near to that at which a primer layer composition essentially melts where contacted to said surface, and then applying on said surface an at least predominantly thermoplastic primer layer and a sign forming tape material bonded thereabove. There is also described a machine designed to be driven along said road pavement and including means designed for performing the said sequential steps in said sheltered environment.

6 Claims, 12 Drawing Figures

MACHINE FOR PREPARING ROAD SURFACES AND FORMING TRAFFIC REGULATING LINES THEREON

This is a continuation of application Ser. No. 868,343, filed Jan. 10, 1978, now abandoned.

BACKGROUND OF THE INVENTION (1) The Field of the Invention

This invention is generally concerned with the art of providing a road or highway surface with center-lines, or traffic-dividing lines, edge lines or other traffic regulating indicia, generally linear and arranged lengthwise of the road, said lines being formed by applying and firmly securing to the surface of the road pavement a prefabricated sign-forming tape material laid upon a relatively thin underlayer (usually termed "primer layer" in the art) of a generally thermoplastic composition usually comprising bitumen or asphalt or the like, capable of thoroughly filling any road pavement surface hollow, hole or pore, thus providing a tape material receiving impervious, flat and planar surface which achieves a firm and permanent bond of said tape material to the road pavement.

More specifically, this invention is concerned with a method and a machine specially designed for applying and securing to a roadway pavement traffic regulating lines and sign as above by performing the various necessary operations even if the road surface is extremely wet and during rainy or otherwise very unfavourable weather.

(2) The Prior Art

The art of road surface marking by making use of prefabricated tape material, as above, is a well worked one and a wide technical and patent literature exists thereabout. The present applicant has carried out a many years long experimental and actual work and has made many improvements to such art. Such improvements related to tape materials, to primer layer compositions, to methods for forming and applying said primer layers and said tape materials. Many problems concerned with the art might be considered as having heretofore been solved. A number of other problems are however still unsolved, principally concerning the forming of road surface signs and lines over an essentially wet and cold road pavement, and principally when operating during a rainy or otherwise unfavourably weather.

For better acknowledge of the prior art most pertinent of this invention a number of prior U.S. patents of the present applicant will hereinbelow be referred to.

Prefabricated tape materials having antiskid and high nighttime visibility properties, and various improvements thereto, have been described in the U.S. Pat. Nos. 3,587,415, 3,935,365 and 4,020,211, and also in my patent application Ser. No. 617,447, filed on Sept. 26, 1976 (now U.S. Pat. No. 4,069,281).

Machines for forming a suitable primer layer, compositions therefor and devices for laying a prefabricated tape material on said layer; and their improvements, have been described in my prior U.S. Pat. Nos. 3,007,838, 3,155,564, 3,235,436, 3,844,669, and 3,964,559. Some devices adapted to complement said machines have been described in my U.S. Pat. No. 3,964,835.

The principal problems encountered and faced in the most convenient selection of the compositions of the primer layer, and of the various temperature and time parameters involved in forming predominantly thermoplastic primer layers and in securing that the formed sign or indicium will be rapidly able to resist the traffic, have been extensively discussed in my U.S. patent application Ser. No. 652,523 filed on Jan. 26, 1976 (now U.S. Pat. No. 4,082,587).

The present applicant has recently devised and proposed a new and advantageous method for forming a traffic regulating line or indicium on a road pavement, by substantially applying the above considered basic art. Such new method is object of my co-pending patent application Ser. No. 758,693, filed Jan. 12, 1977 and matured into U.S. Pat. No. 4,102,718.

Such new method comprises the sequential steps of melting an at least predominantly thermoplastic primer, firmly bonding the molten primer as a layer to a face of the tape material to thereby form a two-layered indicium band, and pressing said indicium band down against the road surface while the primer layer is in an at least partially molten condition and with sufficient force to drive the primer layer into pores and cavities of the road surface.

In consideration of the fact that a preferred embodiment of this invention, as hereinbelow described, contemplates the use of said improved method, inter alia, the expression "primer and tape two-layered band", or an equivalent one, will be made use of for defining in the following description and in the appended claims, the above indicated composite stratified material designed to be unitarily laid on and secured to the road pavement.

SUMMARY OF THE INVENTION

According to the invention, the method generally comprises two principal treatments consisting (a) of providing a complete both physical and thermal preparation of the road surface and pavement, at the surface area thereof designed to have the sign or indicium forming tape material applied thereto over a primer layer, and (b) of actually laying down of and securing the said material to the said surface area, the method being noted by that it can be made use of even if such road surface is very wet, such as under rain, snowfall and in general during unfavourable weather conditions. The invention therefore removes a most serious limitation of the prior art. The invention contemplates also a machine including a composite vehicle adapted to be driven over a road surface and comprising a ceiling wall forming structure and side walls designed to define a weather and splash protected environment above the road surface area to be marked and wherein the said treatments (a) and (b) are carried on. The treatment (a) comprises the sequential steps or performing an effective combined doctoring and washing action on the road surface area, selectively drying said area and heating such area up to a temperature at which an essentially thermoplastic primer layer melts at its road surface contacting face, and the treatment (b) comprises applying and doctoring said primer layer down against the thus cleaned, dried and heated surface area and applying and firmly securing the sign-forming tape material on such primer layer.

According to a preferred embodiment of the invention the said treatment (b) comprises applying and pressing on the said road surface area a primer and tape two-layered band wherein the primer layer is, at the time of contact with and pressing on said area, set at a viscosity sufficient to substantially resist the applied pressure, while the necessary molten condition for compenetrating the primer into the pores and cavities of the road surface is locally promoted only at the downturned face of the primer layer, by locally applied heat, principally by the heat transferred from the heated road surface area.

These and other objects, features and advantages of the invention will become best apparent from the following detailed description of a preferred embodiment thereof, taken together with the accompanying drawings.

THE VIEWS OF THE DRAWINGS

DETAILED DESCRIPTION OF THE PREFERRED EMBODIMENT

Figure 1:
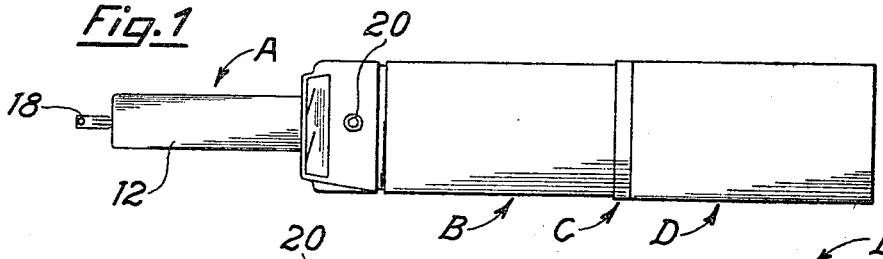
FIGS. 1 and 2 are a view from above and respectively a side elevation of the machine, somewhat diagrammatically illustrated in small scale.
Figure 2:
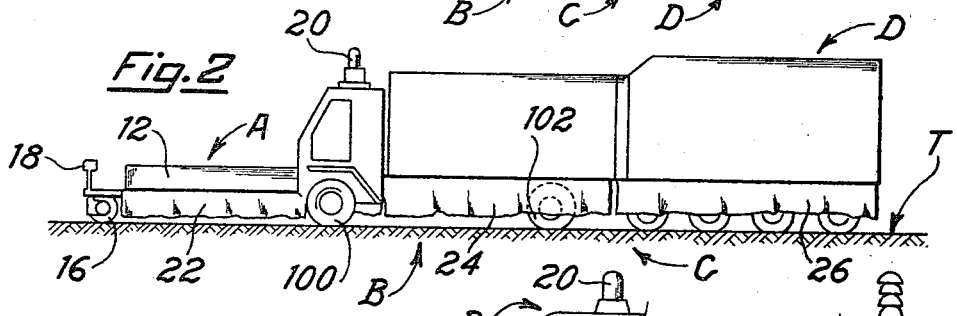

Briefly describing the machine in its entirety, as shown in FIGS. 1 and 2, said machine generally comprises, in the direction in which same machine is driven along a road surface generally indicated at T, for service, a fore portion A wherein the road surface washing and cleaning devices are arranged and operate, a middle portion B wherein the road surface drying and heating means are arranged and operate, a part at C wherein the sign forming tape material M is applied upon a primer layer P on the surface T, and preferably a rear portion D in which the supply of the necessary materials is carried.

Generally, the portion B consists of a nearly conventional motor-lorry or truck having a driver cab 10. The fore portion A consists of a carriage or van drivedly pushed by the motor-vehicle B and having a structure 12 (FIGS. 3 and 4) having a rear end portion connected by means of a universal joint at 14 to the frame of the vehicle and a fore end portion supported for movement on the road surface T by means of an operator stereable one or two-wheeled carriage 16. Suitable means, such as a sight 18, are provided for facilitating the proper alignment of the fore portion A of the machine along the path on which the line or sign is to be formed on the road surface.

The same structures of the portions A and B form a ceiling or roof for the surface area on which the sign is to be formed and therefore which are to be prepared for. The machine is designed to travel along said path and usually to occupy a part only of the road surface, so that the remaining part of said surface, such as of a highway, remains available to the traffic and to passage of motor vehicles by the machine's side. The same machine is provided with suitable signalling means, such as warning signs and lights, one or more flashlights 20 and so on.

The protection provided by the ceiling formed by the structures of portions A and B is however not sufficient for completely sheltering the surface area to be prepared and marked from the rain in windy weather and principally from the splashes promoted by the motor vehicles which pass by its side. Therefore the sheltering is complemented by side wall forming curtains 22, 24 and 26 made e.g. of fabric reinforced rubbery sheets hanging from the sides of the rigid machine structures. It may be noted that the rear portion D is also provided with curtain means 26 (FIG. 2) and provides a shelter for a substantial length of road surface area which follows the location C where the marking material has been already laid. This additional downstream sheltering is useful for having the freshly formed sign protected from weather and splashes and thus ensuring the protection during the prosecution of the setting of the primer layer P.

Figure 3:
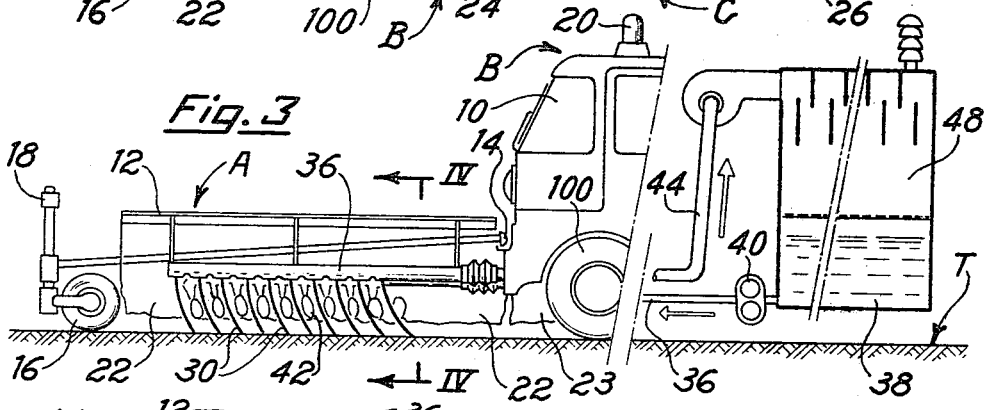
FIG. 3 is a partly a longitudinal vertical sectional fragmentary view of the fore portion of the machine, associated with a diagrammatical view of means which supply the road surface washing devices.
Figure 4:
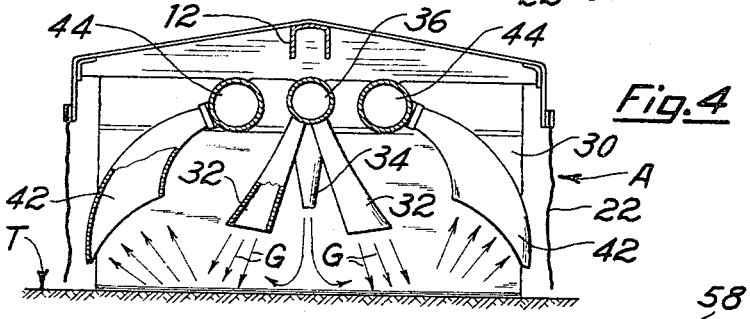
FIG. 4 is a sectional view, taken in the plane indicated at IV—IV in FIG. 3, and illustrates is greater scale and detail said device.

The washing step and the means provided therefor are shown in FIGS. 3 and 4. In the sheltered environment confined below the roof forming structure 12 and between the side curtains 22, a plurality of road surface spaced scavenging transverse blades 30 is secured to said structure 12. Said blades are preferably formed by rather heavy but resilient and stress and wear resistant natural or synthetic rubber sheets. In the spacings between adjacent blades 30 downwardly directed nozzles 32 and 34 are positioned for projecting jets G of pressurized water on the road surface T. Such nozzles are connected by a common duct 36 to a supply 38 of water and a pump 40 provides for the necessary pressure. The amount of water is dependent, as determined by experimentation, from the actual condition of the road surface (amount and nature of dirt, mud and the like). In the most of the occurrences and for saving water (which must be carried in and out by the machine) a proper washing and cleaning of the road surface T can be attained by projecting jets G of moist pressurized air, such as by feeding the nozzles 32, 34 with a pressurized air stream in which finely divided water is injected by means of a suitable and conventional spray or Venturi tube device (not shown); the water content of the moist air can be adjusted, by operating suitable valve means (not shown) for providing the best balance of water consumption and cleaning effect at the various actual road surface conditions.

Further, a substantial water saving can be preferably provided by locating suction hoppers 42 where the water drops mostly bounce from the impinged area of the road surface T, said hoppers 42 being connected by means of intake ducts 44 to an exhaust fan 46 and to a collecting and recycling tank 48. Upon at least partial removal of the solid substances from the such recovered water, this water is recycled in the supply 38. As confirmed by actual tests, the provision and the operation of scavenging means such as above described and diagrammatically shown (the actual details and individual devices can be devised and provided by those skilled in the art) a narrow strip of clean road surface, stripped from dirt, mud and other substances which might prejudice the proper application and securing of the road-marking material, is formed and maintained until such material is laid on at location C.

Figure 5:
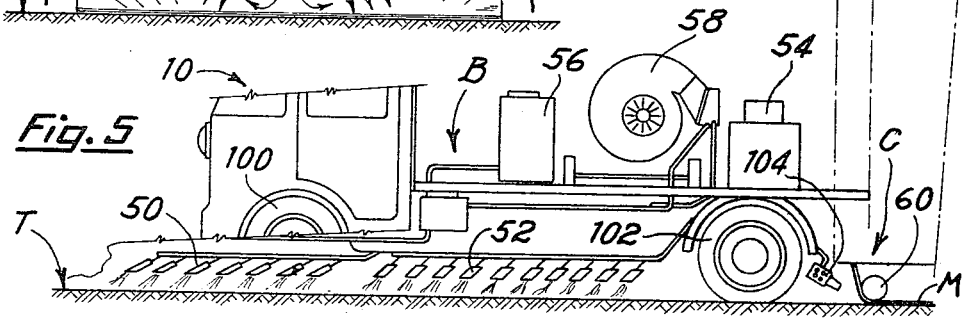
FIG. 5 is a side fragmentary elevation of the part of machine wherein the road surface drying and heating devices are arranged, the side wall forming components being removed.

Said narrow strip of cleaned road surface is then dried and heated as the portion B of the machine travels thereabove. As shown in FIG. 5, an alignment or string of nozzles 50 is provided for issuing jets of hot pressurized air (or of pressurized overheated steam) on the centre-line of said strip and another alignment or string of burners 52 is provided for projecting concentrated flames (or jets of very hot gases) on the same centre-line. Said drying and heating means can be constructed, supported and supplied by applying current art and therefore any further description is superfluous. Some complemental devices and means are however shown in FIG. 5, e.g.: numeral 54 indicates a tank or bottle for liquified gas fuel, 56 a water tank and 58 a powerful blower such as adapted for feeding the road surface cleaning jets G from nozzles 32, 34, the illustration of a few of supply and service means in FIG. 5 being purely diagrammatical and illustrative for the provision of such means in the machine in particular in the portion B of the machine.

The road marking material is applied at C, as above indicated, that is where, during the forward displacement of the machine, a length of a perfectly clean, dry and hot narrow road surface area exists below the machine. As diagrammatically shown in FIG. 6 and more detailedly in FIG. 7, the material, more preferably a two-layered band comprising a marking tape material M and a primer layer P′ is supplied and progressed below an applying roller 60 and then downwardly pressed by means of at least one pressure roller 62. The two-layered band is prepared in the device 64 (see FIGS. 7 and 8 for details) by passing the prefabricated tape material M, usually unwound from bobbins (not shown) carried in the portion D of the machine, upon heating of such tape through a oven 66.

The said device 64 comprises a guide passage 70 having an upwardly turned aperture which forms the outlet of an inverted hopper 72 wherein a supply of molten primer composition 74 is fed, and therefore contacted with one face of the tape M (the face which will be successively downwardly turned). A plate 76, guidedly movable in the structure of hopper 72, forms a doctor blade for forming the primer layer P′ on said one face of the tape M. The thickness of said primer layer P′ can be adjusted by moving said plate 76, such as by means of an actuator including a rack 78 integral with said plate 76 and meshing with a pinion 80, gear means 82 and a motor 84.

The provision of primer layer thickness adjusting means is advantageous by that such provision allows to adapt such thickness to the actual physical condition of the road surface T, namely to the irregularity thereof. It is evident that the more the said surface is irregular, the thicker the layer P′ must be for properly filling the pores and hollows of the road surface and for forming a uniform planar and smooth primer layer. Sensing means for sensing the actual condition of the road surface T can be provided at 86, that is a location wherein a yet cleaned surface can be sensed, and at 88, wherein a stratified band has been already applied to the road surface.

Figures 6, 7, 8, 9, 10, 11, 12:
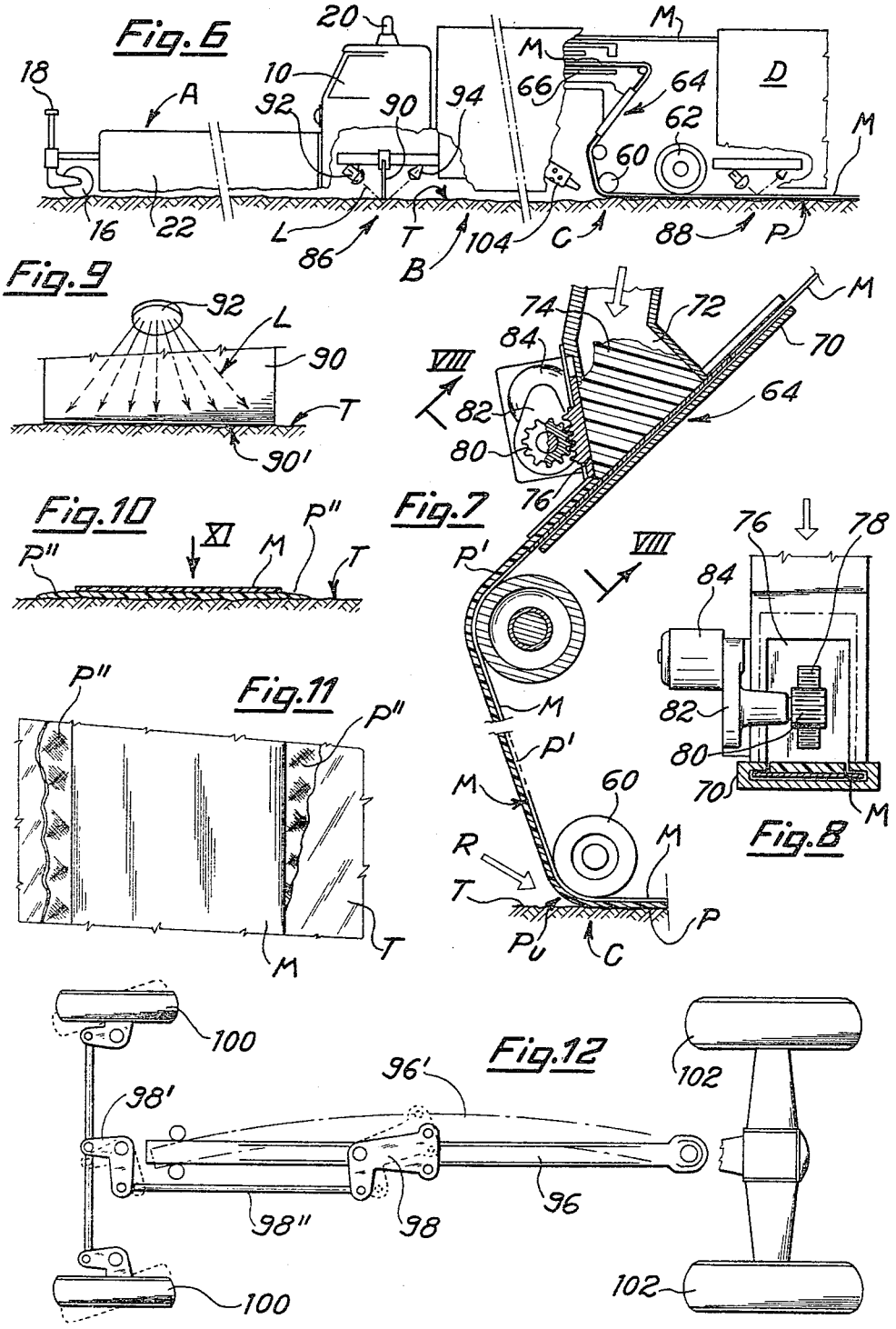
FIG. 6 is a somewhat diagrammatical fragmentary side elevation of the parts including certain road surface condition control means and the two-layered band preparing and applying means.
FIG. 7 is a fragmentary partly sectional view of a two-layered band preparing device.
FIG. 8 is a partly elevational and partly a sectional view, taken from the plane indicated at VIII—VIII in FIG. 7, of a mechanism comprised in said device.
FIG. 9 is a diagrammatical partly elevational a partly sectional fragmentary view which illustrates how one of the road surface condition control means operates.
FIG. 10 is a fragmentary cross-sectional view of a road surface area on which a two-layered marking band has been applied.
FIG. 11 is a fragmentary view of the said area, seen in the direction indicated at —XI— in FIG. 10.
FIG. 12 is a diagrammatical illustration of a mechanism, seen from above, associated to the vehicle structure.

As diagrammatically illustrated in FIGS. 6 and 9, the sensing means at 86 comprise a transverse nearly vertical scraping blade 90 having a horizontal straight lower edge 90′ (FIG. 9) which slides over the road surface T. A source of light 92 and a light sensing cell 94 are located at the opposite sides of said blade 90. The light source 92 illuminates the slit or cleft formed below the said straight edge 90′ and the sensor 94 senses the amount of the light beams L which can pass under said edge 90′, an amount which is evidently proportional to the irregularity of the road surface, that is to the defectiveness of contact between the not planar surface and the straight edge 90′.

The sensing device at 88 senses the amount of the primer layer P composition which has actually sidewardly squeezed below the tape M upon the pressure applied by the roller 62. The squeezed off amounts of the primer layer are fragmentarily and diagrammatically exemplified at P″ in FIGS. 10 and 11. It is evident that the existence and the amount of said primer layer squeezed off portion P″ are indicative of defective or respectively excessive amounts (that is thickness) of the preformed primer layer P′, and therefore of the irregularity of the road surface T. This latter sensing device can comprise pairs of lamps positioned for illuminating the opposite edges of the tape T and light sensitive means positioned to sense the amount of the reflected light, or other suitable means for sensing the said squeezed off portions P″ of the primer layer P pressed below the tape material T.

The outlet signals of the devices at 86 and/or 88 can be amplified and processed for actuating the motor 84 that is for adjusting the position of the doctor plate 76 and the thickness of the primer layer P′ formed on the tape T. Signals provided by both sensors at 86 and at 88 can be combinedly processed for providing an integrated signal which is more indicative of the actual variable conditions of the road surface at the various locations on which the machine operates.

It is evident that the above described method and machine require substantial amounts of energy in the operation; in view of economy, the greatest part of such energy is that necessary for heating the surface layer of the road pavement up to a temperature such to superficially melting the underface Pu of the primer layer P where contacting the road surface. For best localization of said melting, an additional burner 104 can be positioned (FIGS. 5 and 6) for localizing heat in the exact direction R (FIG. 7) where most convenient for localized and surface melting the said underface Pu of the primer layer.

On the other hand, the driving of melt primer layer underface into the road surface pores and cavities critically requires that the road pavement will be substantially heated down to a certain depth. Such requirement leads to the provision of a string of aligned burners, such as indicated at 52, and of a co-aligned string of hot gas emitting nozzles 50, so that a very narrow strip (for energy saving) of dry and heated surface will be provided. Such arrangement satisfyingly operates where the path along which the machine travels and the marked line is to be formed is straight. When a curved road is to be marked, a wider clean, dry and heated strip of the road pavement is necessary for spanning over the curve path to be followed.

The mechanism illustrated in FIG. 12 provides for overcoming the above limitation. Numeral 96 generally indicates a laterally flexible or otherwise deformable elongated structure extended lengthwise of the vehicle which forms the portion B of the machine, between the front steerable wheels 100 and the rear wheels 102 thereof. Such structure is connected by means of link and lever means 98, 98' and 98'' to the front steering mechanism of the vehicle, so that when the said vehicle is steered for displacement along a curve path, the structure is caused to bend into a corresponding curve. The strings of nozzles 50 and of burners 52 are secured below and supported by said structure 96 of FIG. 12 and are caused to concurrently bend, so that the drying and heating energy consuming actions will be exerted just only where the road pavement is to be dried and heated for road marking purpose. In FIG. 12 the mechanism is indicated by dot-and-dash lines at 96' in one possible bent condition.

I claim:

1. A machine for forming an essentially linear traffic regulating sign on a road surface and along a given path, by applying and securing a prefabricated tape material above a predominantly thermoplastic primer layer on said surface, comprising a composite motor vehicle adapted to be driven on said road surface along said path, said vehicle carrying, in the direction of its travel for service, washing means for washing a substantially narrow strip of said surface having its center-line about at said path, drying means for drying said surface area strip, primer layer and prefabricated tape material applying and pressing means for applying a tape material above a primer layer on the said washed and dried road pavement surface area, and a structure having parts above said surface area and forming a ceiling wall and side wall forming curtain means hung from side parts of said structure to provide a confined environment above said surface area so that the latter is located and the washing, drying and applying means operate in a space sheltered from external weather and splashes.

2. A machine for forming an essentially linear traffic regulating sign on a road surface and along a given path, by applying and securing a prefabricated tape material above a predominantly thermoplastic primer layer on said surface, comprising a composite motor vehicle adapted to be driven on said road surface along said path, said vehicle carrying, in the direction of its travel for service, washing means for washing a substantially narrow strip of said surface having its center-line about at said path, drying means for drying said surface area strip, heating means for heating the road pavement upper surface portion in the narrow area including said path, primer layer and prefabricated tape material applying and pressing means for applying a tape material above a primer layer on the washed, dried and heated road pavement surface area, and a structure having parts above said surface area and forming a ceiling wall and side wall forming curtain means hung from side parts of said structure to provide a confined environment above said surface area so that the latter is located and the washing, drying and applying means operate in a space sheltered from external weather and splashes.

3. The machine of claim 2, comprising further a road surface marking two-layered band forming device and applying means for applying said band on said surface area upon turning such band so that the face of the primer layer, opposite to the tape, will contact the road surface, and additional heating means for locally heating up said opposite face of said primer layer when said face is approaching said road surface.

4. The machine of claim 2, wherein the said washing means comprise a plurality of transversely arranged and spaced road surface scavenging blades, nozzle means directed for emitting jets of a pressurized water containing fluid in the spacings between said blades to impinge on the road surface, and a source of the pressurized water containing fluid connected to said nozzle means for supplying said jets.

5. The machine of claim 4, comprising further suction ports and means positioned to collect from between said blades at least part of the water drops upwardly bouncing from the road surface upon having been impinged thereon, and recycling means for recovering and recycling to said source the collected water.

6. The machine of claim 2, and wherein the said road surface area drying and heating means comprise longitudinally aligned strings of hot gases emitting nozzles and respectively of flame emitting burners located above said path and directed to impinge on said road surface, comprising further a deformable structure adapted to be curved concurrently with said path to support said nozzles and burners to adapt the locations of impingement to the actual road and path curvature.

* * * * *